US005946743A

United States Patent [19]

Hashmi

[11] Patent Number: 5,946,743

[45] Date of Patent: Sep. 7, 1999

[54] SELF-DRAINING POOL COVER

[76] Inventor: Imaduddin S. Hashmi, 585 Steuben St., Staten Island, N.Y. 10305

[21] Appl. No.: 09/038,116

[22] Filed: Mar. 11, 1998

[51] Int. Cl.[6] ..... E04H 4/00

[52] U.S. Cl. ..... 4/498; 4/496

[58] Field of Search ..... 4/496, 498–503; 83/697, 835, 847; 30/113.1, 278, 346.56, 388

[56] References Cited

U.S. PATENT DOCUMENTS

| | | | |
|---|---|---|---|
| 2,990,615 | 7/1961 | Ohler | 30/113.1 |
| 3,184,764 | 5/1965 | West | 4/498 |
| 3,822,715 | 7/1974 | Rao . | |
| 4,310,969 | 1/1982 | Cannizzaro et al. | 30/113.1 |
| 4,318,421 | 3/1982 | Ward . | |
| 4,406,300 | 9/1983 | Wilson . | |
| 4,865,069 | 9/1989 | Lacey . | |
| 5,056,223 | 10/1991 | Buck et al. | 30/113.1 |
| 5,343,888 | 9/1994 | Stelzer . | |
| 5,802,629 | 9/1998 | Zietek | 4/498 |

FOREIGN PATENT DOCUMENTS

| | | |
|---|---|---|
| 639615 | 7/1950 | United Kingdom . |

*Primary Examiner*—Charles R. Eloshway
*Attorney, Agent, or Firm*—Richard C. Litman

[57] ABSTRACT

A self-draining pool cover in which a standard pool cover is provided with a centrally located aperture. A collar passes through the aperture sealed by a rubber grommet. The upper end of the collar has a circumferential flange and external threads. An internally threaded nut is received by the collar and tightened. This tightening compresses the grommet, making a water-tight seal. A hose connects the lower end of the collar to the skimmer of a pool. In this manner water travels through the collar down the tube out to the skimmer, preventing the build up of stagnating water on the surface of the pool cover.

4 Claims, 4 Drawing Sheets

SELF-DRAINING POOL COVER

BACKGROUND OF THE INVENTION

1. Field of the Invention

The present invention relates to pool accessories. More specifically, the present invention relates to a self draining pool cover.

2. Description of the Related Art

During the off season, swimming pools are covered to prevent the accumulation of leaves and other debris within the swimming pool. This debris however then accumulates on the cover, along with any precipitation. The precipitation lays on the pool cover forming bog, in which the debris may rot, the water stagnate, or gather house pests, or cause all of these. To prevent these undesirable situations, the water must be removed from the cover.

Previous devices for removing water from a pool cover have been the subject of earlier patents. U.S. Pat. No. 4,318,421, which issued to Ward on Mar. 9, 1982, discloses a float controlled syphon valve for swimming pool cover. A float controlled valve having male and female members allows syphoning of water off the cover when a certain level is reached. Similarly, U.S. Pat. No. 5,343,888, which issued to Stelzer on Sep. 6, 1994, discloses an automatic syphon system. The system may be adapted for use with a swimming pool cover, and syphons water off the cover when a certain level of water is reached. Both devices depend upon a fixed amount of water remaining on the cover in order to maintain syphon action.

Other devices are known for transferring water from one place to another, but are less related to removing water from pool covers. Many of these patented devices include complex structures to maintain syphon power, which may be necessary when dealing with large irrigation or similar pump lines. Examples of such patents include U.S. Pat. No. 3,822,715 (irrigation siphon apparatus) which issued to Rao on Jul. 9, 1974; U.S. Pat. No. 4,406,300 (roof siphon drain) which issued to Wilson on Sep. 27, 1983; U.S. Pat. No. 4,865,069 (fluid drain pump) which issued to Lacey on Sep. 12, 1989; and British Patent Document 639,615 (improvements relating to valves, particularly float-operated valves) published on Jul. 5, 1950.

None of the above inventions and patents, taken either singularly or in combination, is seen to describe the instant invention as claimed. Thus a self draining pool cover solving the aforementioned problems is desired.

SUMMARY OF THE INVENTION

The present invention is a self-draining pool cover. A standard pool cover is provided with a centrally located aperture.

The aperture has a seal, such as a rubber grommet, through which a collar passes, having an upper end and a lower end. The upper end of the collar has a circumferential flange and external threads. The flange engages the top surface of the seal. An internally threaded nut is received by the collar and tightened. This tightening compresses the seal, making a water-tight seal. The lower end is a cylinder which integrally extends the collar, to which a hose connects feeding the runoff through the collar into the skimmer of a pool. In this manner water travels through the collar down the tube out to the skimmer, preventing the build up of stagnating water on the surface of the pool cover.

Accordingly, it is a principal object of the invention to prevent the accumulation of precipitation on a pool cover.

It is another object of the invention to direct water from the surface of the pool cover to the pool's skimmer.

It is a further object of the invention to convert a standard pool cover into a self-draining pool cover of the invention.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Referring now to the Figures by numerals of reference, a self-draining pool cover of the present invention is shown. The invention may be made by using an existing pool cover or may include its own. In either case, the self-draining pool cover drains water through a device located in a centrally located aperture through a hose to a skimmer attached to the pool.

Figure 1:
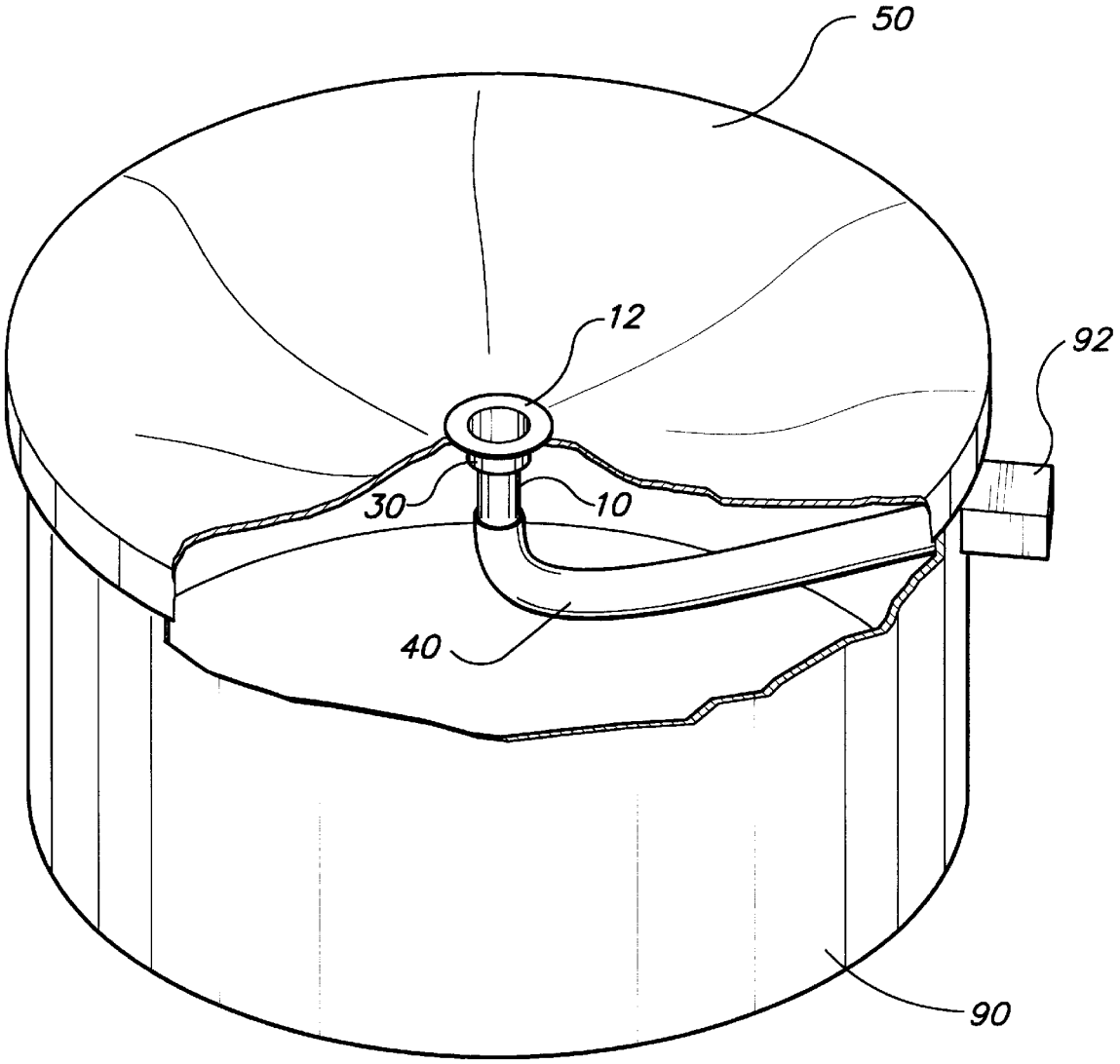
FIG. 1 is an environmental, perspective, partial cutaway view of a self-draining pool cover according to the present invention.
Figure 2:
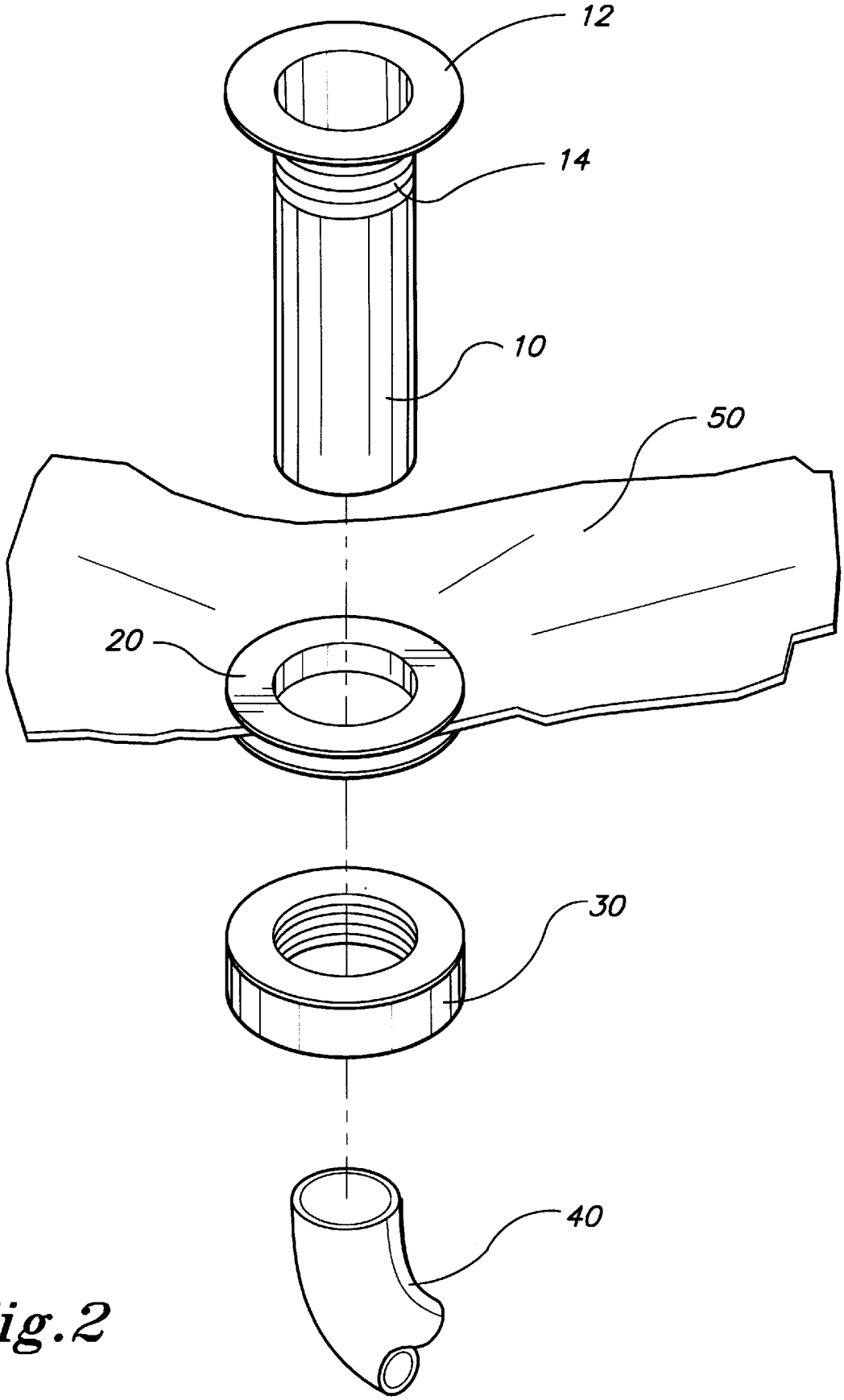
FIG. 2 is an exploded, partial view of the self-draining pool cover of the present invention.
Figure 3:
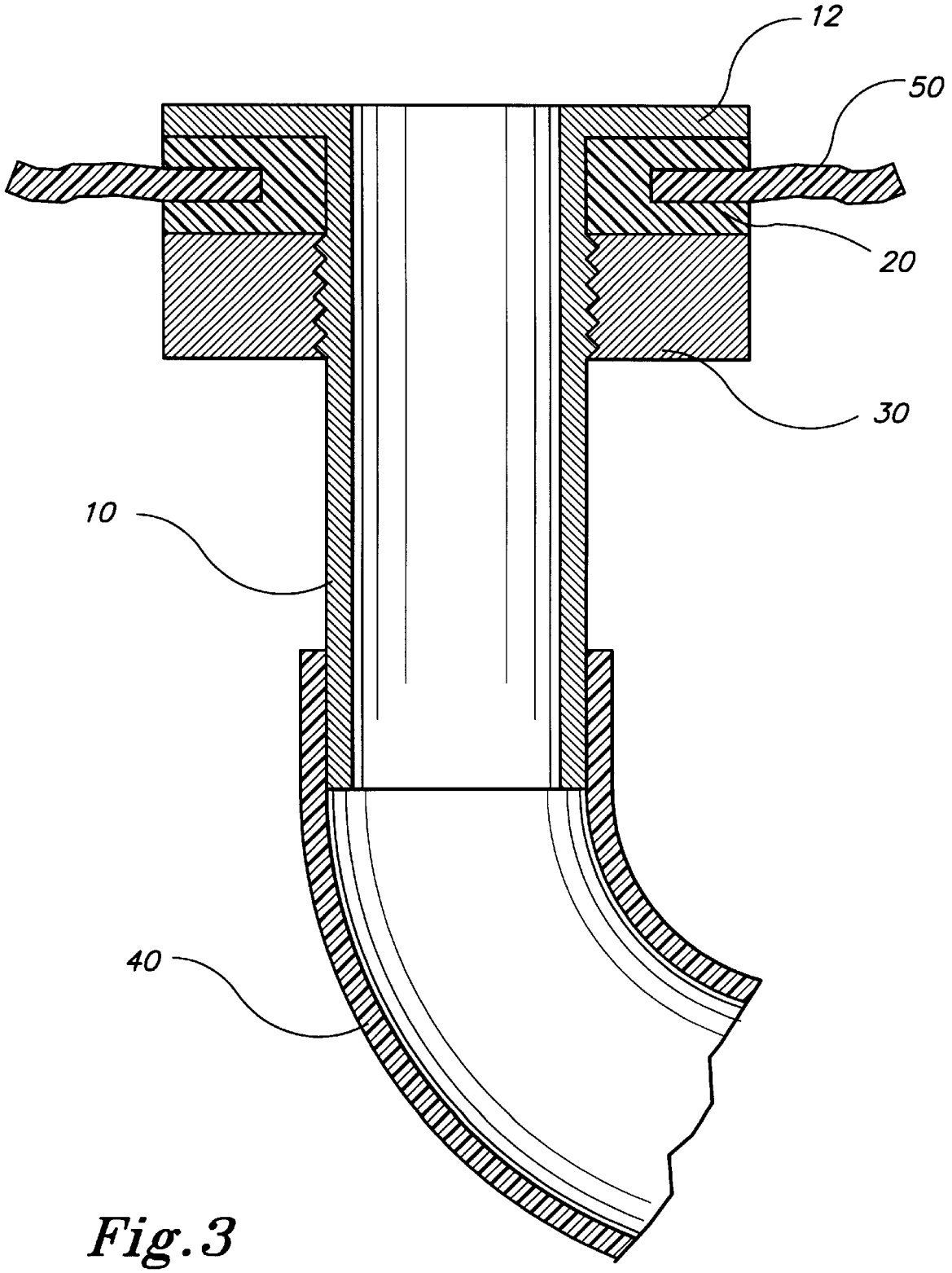
FIG. 3 is cross-sectional, partial view of the self-draining pool cover of the present invention.
Figure 4:
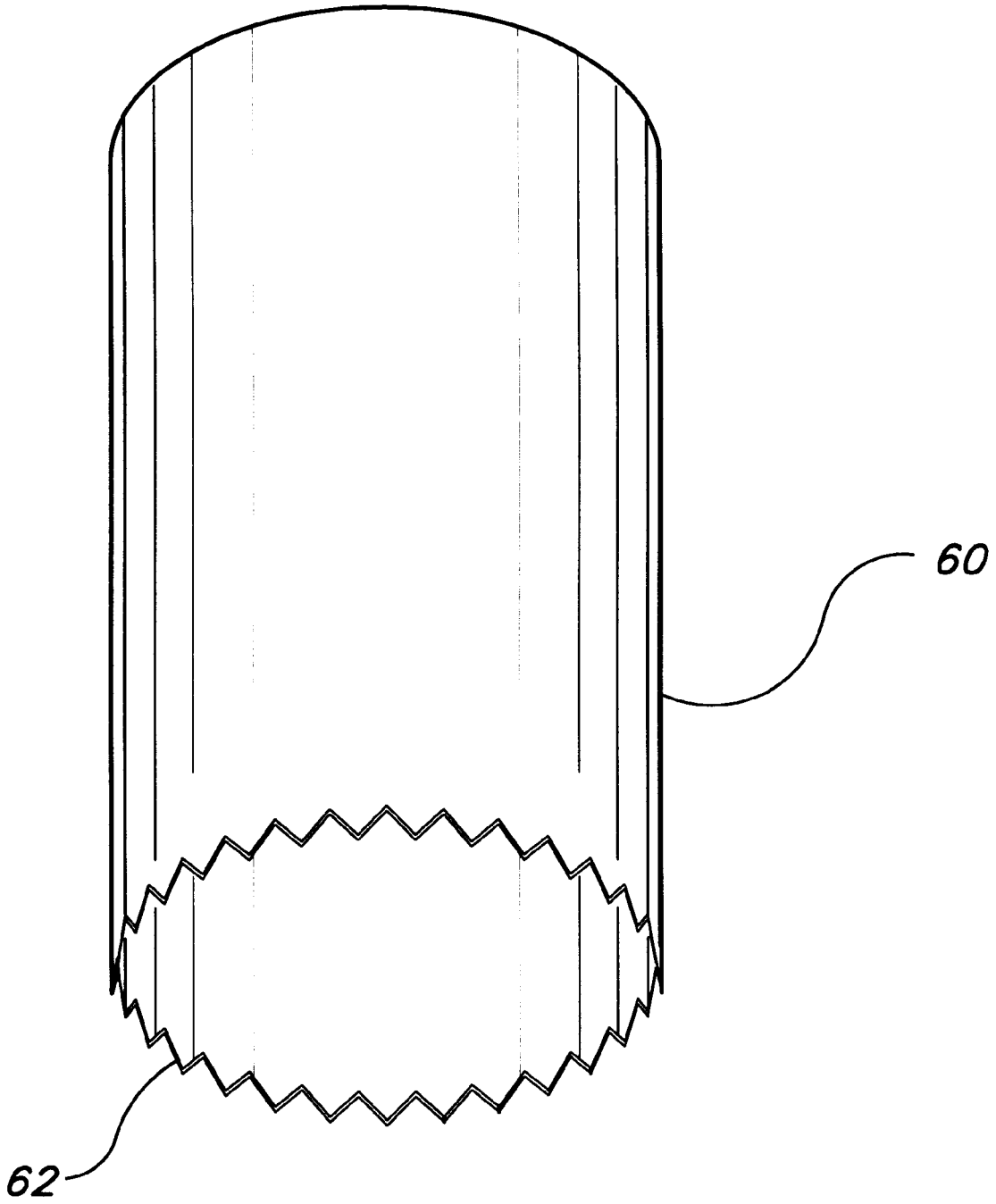
FIG. 4 is a cutting tool disclosed by the present invention.

An aperture must be made in a central position in a standard pool cover 50. In practice, the cover 50 may be manufactured this way or the aperture may be made by any conventional means. Preferably, however, a special cutting tool 60, shown in FIG. 4, will be included as part of a kit for converting a standard pool cover for use with the present device. The cutting tool 60 is a cylindrical body having a serrated lower circumferential edge 62 which is used for cutting through the pool cover 50. The edge 62 may be sharpened plastic or metal and defines a diameter which cuts a hole of equal diameter through which a similarly sized collar or cylinder 10, discussed below, closely passes.

The aperture in the pool cover 50 must be sealed to prevent leakage of the stagnating water into the pool 90. To do this, a rubber grommet 20 is used. The grommet 20 is sized to sealingly engage the material of the pool cover 50 around the hole in the pool cover 50. Alternatively, a pair of rubber washers may be used placed in registry with one another on opposite sides of the pool cover around the hole.

An elongated cylinder or collar 10 is provided and sized to pass through the opening of the grommet 20. The collar 10 has an upper end from which a flange 12 extends circumferentially, the upper end integrally connected with a cylindrical lower end. Along its length and beneath the flange 12, the collar or cylinder 10 is provided with external threads 14. The lower end of the collar is adapted in size to couple with a standard pool hose 40.

An internally threaded nut 30 is provided which is slipped over the cylindrical lower end of the collar 10, engaging the external threads 14 of the collar 10 such that tightening the nut 30 compresses the grommet 20 between the flange 12 of the collar 10 and the nut 30 thereby forming a water-tight seal. The upper surface of the nut 30 may be provided with cork to allow freer rotation against the rubber grommet 20 as the nut 30 is tightened.

To direct water from the pool cover 50, a pool hose 40 connects the lower end of the collar 10 to the skimmer 92 of the pool 90. Instead of accumulating on the surface of the pool cover 50, water drains through the collar 10 into the hose 50 and onto 5 the skimmer 92. In this manner, precipitation is prevented from forming an unsightly bog on the surface of the pool cover.

As suggested above, the invention may take the embodiment of as a retrofit assembly of individual parts, in combination with a cover, or grouped as a kit. For those pool owners that already have a standard pool cover, a kit for converting a standard pool cover to a self-draining pool cover of the invention includes a cutting tool 60, a collar or cylinder 10 with flange 12, a rubber grommet 20, a nut 30, and a hose 40. Otherwise, the pool cover 50 may be included having a pre-cut aperture onto which the assembly is removably attached.

It is to be understood that the present invention is not limited to the embodiments described above, but encompasses any and all embodiments within the scope of the following claims.

I claim:

1. A kit for converting a standard pool cover into a self-draining pool cover, said kit comprising:

generally hollow, cutter tool cylindrical having a laser cutting edge for forming a centrally located aperture in the pool cover; and a device for use with the standard pool cover, said device comprising:

a collar having an upper and a cylindrical lower end, said collar being provided with external threads at its upper end and a flange extending circumferentially from said upper end of said collar;

a compressible sealing means for forming a water-tight seal around the central aperture of the pool cover between the pool cover and said flange;

an internally threaded nut engaging said external threads of said collar such that tightening said nut compresses said means for sealing said aperture between said flange of said collar and said nut thereby forming a seal; and a hose adapted to connect at one end to said lower end of said collar and at the other end to a skimmer of the pool.

2. The kit as defined in claim 1 wherein said lower cutting edge has serrated teeth for cutting an aperture in the pool cover corresponding in size to an outer diameter of the collar.

3. The kit as defined in claim 1 wherein said sealing means is a rubber grommet.

4. The kit as defined in claim 1 wherein said sealing means includes two rubber washers adapted to be placed in registry with one another on opposite sides of said pool cover.

* * * * *